US010784036B2

(12) United States Patent
Kobayashi et al.

(10) Patent No.: US 10,784,036 B2
(45) Date of Patent: Sep. 22, 2020

(54) MAGNETIC COUPLING COIL COMPONENT

(71) Applicant: TAIYO YUDEN CO., LTD., Tokyo (JP)

(72) Inventors: Satoshi Kobayashi, Tokyo (JP); Tomoo Kashiwa, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 284 days.

(21) Appl. No.: 15/937,137

(22) Filed: Mar. 27, 2018

(65) Prior Publication Data

US 2018/0322996 A1 Nov. 8, 2018

(30) Foreign Application Priority Data

May 2, 2017 (JP) ..... 2017-091757

(51) Int. Cl.

| | |
|---|---|
| ***H01F 17/04*** | (2006.01) |
| ***H01F 27/24*** | (2006.01) |
| ***H01F 27/32*** | (2006.01) |
| ***H01F 27/28*** | (2006.01) |
| ***H01F 27/29*** | (2006.01) |
| *H01F 27/38* | (2006.01) |

(52) U.S. Cl.

CPC ..... *H01F 27/24* (2013.01); *H01F 17/045* (2013.01); *H01F 27/2823* (2013.01); *H01F 27/2828* (2013.01); *H01F 27/292* (2013.01); *H01F 27/324* (2013.01); *H01F 27/38* (2013.01)

(58) Field of Classification Search

USPC ..... 336/221

See application file for complete search history.

(56) References Cited

U.S. PATENT DOCUMENTS

| | | | | |
|---|---|---|---|---|
| 5,519,368 | A * | 5/1996 | Heise | H01F 5/02 335/177 |
| 5,923,237 | A * | 7/1999 | Sato | H03H 7/42 336/192 |
| 2002/0021201 | A1* | 2/2002 | Oi | H01F 17/045 336/197 |
| 2007/0063803 | A1* | 3/2007 | Yamashita | H01F 17/045 336/83 |

(Continued)

FOREIGN PATENT DOCUMENTS

| | | | |
|---|---|---|---|
| JP | 2006-196639 | A | 7/2006 |
| JP | 2017-34124 | A | 2/2017 |

*Primary Examiner* — Ronald Hinson

(74) *Attorney, Agent, or Firm* — Pillsbury Winthrop Shaw Pittman LLP

(57) ABSTRACT

One object of the present invention is to provide a magnetic coupling coil component having a coupling coefficient that can be readily adjusted. A coil component according to one embodiment of the present invention includes: a drum core including a winding core, a first flange, and a second flange, the first flange being provided on one axial end of the winding core, the second flange being provided on another axial end of the winding core; a spacer provided on a surface of the winding core between the first flange and the second flange, the spacer being separate from the winding core; a first winding wire wound around the winding core between the first flange and the spacer; and a second winding wire wound around the winding core between the second flange and the spacer.

13 Claims, 10 Drawing Sheets

(56) References Cited

U.S. PATENT DOCUMENTS

| | | | | |
|---|---|---|---|---|
| 2010/0214050 | A1* | 8/2010 | Opina, Jr. | H01F 27/292<br>336/192 |
| 2014/0167903 | A1* | 6/2014 | Tomonari | H01F 17/045<br>336/220 |
| 2016/0247627 | A1* | 8/2016 | Baker | H01F 27/346 |

* cited by examiner

MAGNETIC COUPLING COIL COMPONENT

CROSS-REFERENCE TO RELATED APPLICATIONS

This application is based on and claims the benefit of priority from Japanese Patent Application Serial No. 2017-91757 (filed on May 2, 2017), the contents of which are hereby incorporated by reference in their entirety.

TECHNICAL FIELD

The present invention relates to a coil component. In particular, the present invention relates to a magnetic coupling coil component including a pair of coil conductors magnetically coupled to each other.

BACKGROUND

A magnetic coupling coil component includes a pair of coil conductors magnetically coupled to each other. Examples of magnetic coupling coil component include a common mode choke coil, a transformer, and a coupling inductor.

A magnetic coupling coil component is preferably configured such that the coupling coefficient between a pair of coil conductors can be readily changed.

In Japanese Patent Application Publication No. 2017-34124 ("the '124 Publication"), there is disclosed a magnetic coupling coil component which includes an intermediate flange formed near the axial middle portion of a winding core. In this coil component, one of a pair of winding wires is wound around the winding core between the intermediate flange and a first flange, and the other of the pair of winding wires is wound around the winding core between the intermediate flange and a second flange. The '124 Publication discloses that the width of the intermediate flange can be adjusted to adjust the coupling coefficient between the pair of winding wires (see paragraph [0041]). The intermediate flange is integrated with the winding core (see paragraph [0024]).

In Japanese Patent Application Publication No. 2006-196639, there is also disclosed a coil component which includes an intermediate flange formed on a winding core. In this coil component, the number of intermediate flanges can be changed to adjust the coupling coefficient.

As described above, conventional coil components include an intermediate flange integrated with the winding core. In many cases, a drum core is formed by pressing a mixture of calcined ferrite powder and a synthesized resin binder to form a shaped object and then firing the shaped object. Since fired ferrite is brittle, it is difficult to integrate an intermediate flange having a desired shape with the winding core. Therefore, in conventional coil components having an intermediate flange, it is difficult to adjust the coupling coefficient due to the difficulty of production.

In conventional coil components having an intermediate flange, it is difficult to form the intermediate flange at a desired position with respect to the axial direction of the winding core. If the intermediate flange is off the desired position, there is possibility that a required length of winding wire cannot be wound.

To achieve a desired coupling coefficient, it may be necessary to form the intermediate flange to have a small thickness. A thin intermediate flange is prone to be broken. Conversely, when the intermediate flange is formed to have a large thickness to ensure strength, the distance between the pair of coils is large, and therefore, the coupling coefficient cannot be sufficiently large.

SUMMARY

An object of the present invention is to relieve or overcome at least a part of the above problem of the conventional art.

One particular object of the present invention is to provide a magnetic coupling coil component having a coupling coefficient that can be readily adjusted.

One particular object of the present invention is to facilitate accurate positioning of a member for adjusting the coupling coefficient at a desired position on the winding core.

One particular object of the present invention is to facilitate adjusting of the coupling coefficient of the magnetic coupling coil component using a member less prone to be broken.

Other objects of the present invention will be apparent with reference to the entire description in this specification.

A coil component according to one embodiment of the present invention comprises: a drum core including a winding core, a first flange, and a second flange, the first flange being provided on one axial end of the winding core, the second flange being provided on another axial end of the winding core; a spacer provided on a surface of the winding core between the first flange and the second flange, the spacer being separate from the winding core; a first winding wire wound around the winding core between the first flange and the spacer; and a second winding wire wound around the winding core between the second flange and the spacer.

In the coil component according to the embodiment, the material of the spacer and/or the width of the spacer in the axial direction of the winding core can be changed to adjust the coupling coefficient between the first winding wire and the second winding wire. Since the spacer is made separate from the winding core, the material and the width of the spacer can be readily changed. Therefore, in the magnetic coupling coil component according to the above embodiment, the coupling coefficient can be readily adjusted. In the above embodiment, a spacer made separate from the winding core can be disposed at a desired position on the winding core, and therefore, a spacer for adjusting the coupling coefficient can be disposed accurately at a desired position on the winding core.

In a coil component according to one embodiment of the present invention, the spacer is made of a flexible member. The flexible member may be formed of a resin material such as polyamide, nylon, polyethylene terephthalate, or polyimide.

In the magnetic coupling coil component according to the above embodiment, the coupling coefficient can be adjusted using a member less prone to be broken.

At least a part of the spacer is made of an insulating sheet. The insulating sheet has, for example, a band shape. The insulating sheet may be provided on the drum core so as to extend along an axial direction of the winding core. One end of the insulating sheet may be fixed to the first flange, and another end of the insulating sheet may be fixed to the second flange.

In the coil component according to the above embodiments, the thickness or material of the insulating sheet can be changed to adjust the coupling coefficient of the coil component. Therefore, in the magnetic coupling coil component according to the above embodiments, the coupling coefficient can be readily adjusted.

A coil component according to one embodiment of the present invention further comprises an insulating exterior portion provided around the winding core so as to cover at least a part of the winding wires, wherein the spacer includes a part of the exterior portion.

Various embodiments of the invention disclosed herein will provide a magnetic coupling coil component having a coupling coefficient that can be readily adjusted.

BRIEF DESCRIPTION OF THE DRAWINGS

In FIG. 9, a ring is removed from a drum core for convenience of description.

In FIG. 10, the ring is mounted on the drum core.

DESCRIPTION OF THE EMBODIMENTS

Various embodiments of the invention will be described hereinafter with reference to the drawings. Elements common to a plurality of drawings are denoted by the same reference signs throughout the plurality of drawings. It should be noted that the drawings do not necessarily appear in accurate scales, for convenience of description.

Figure 1:
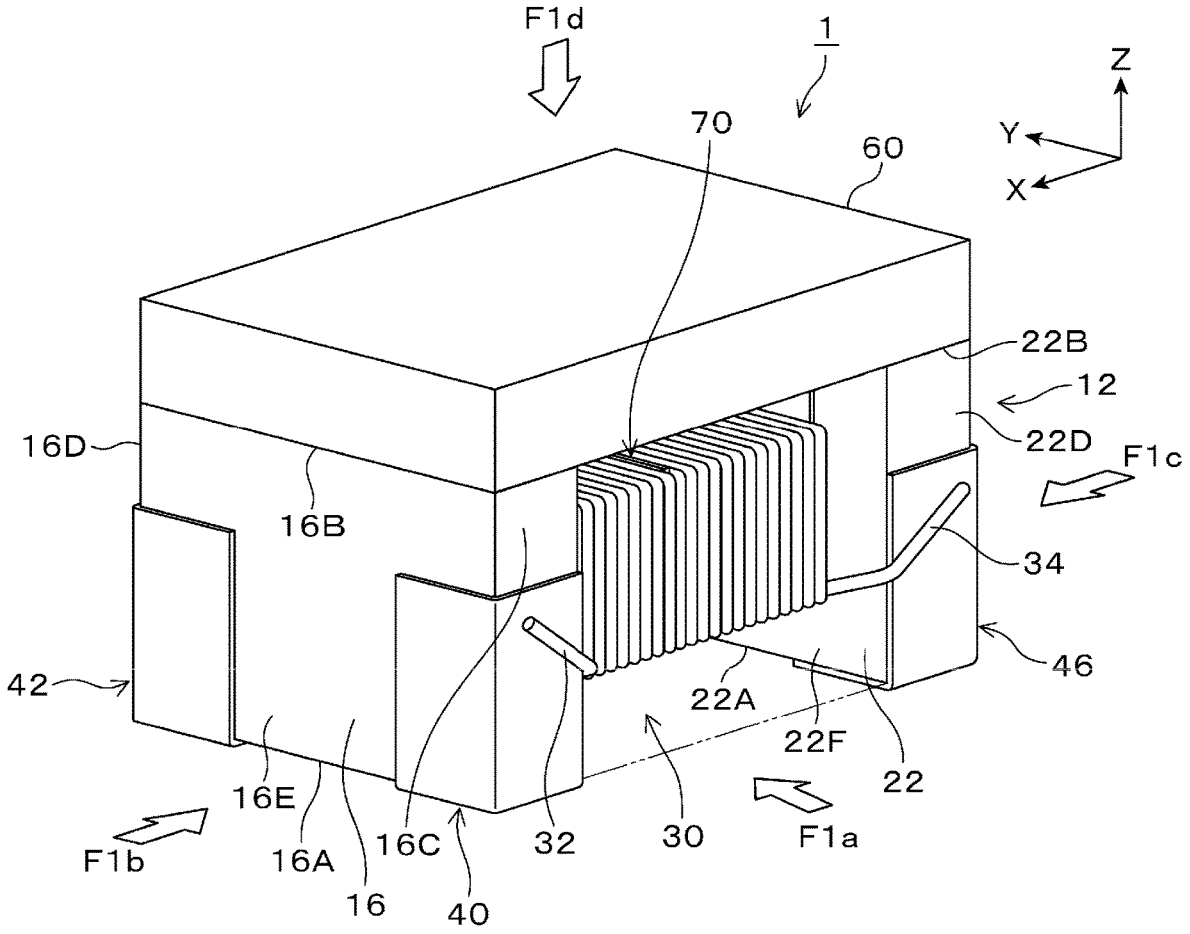
FIG. 1 is a perspective view showing a coil component according to one embodiment of the present invention.
Figure 2:
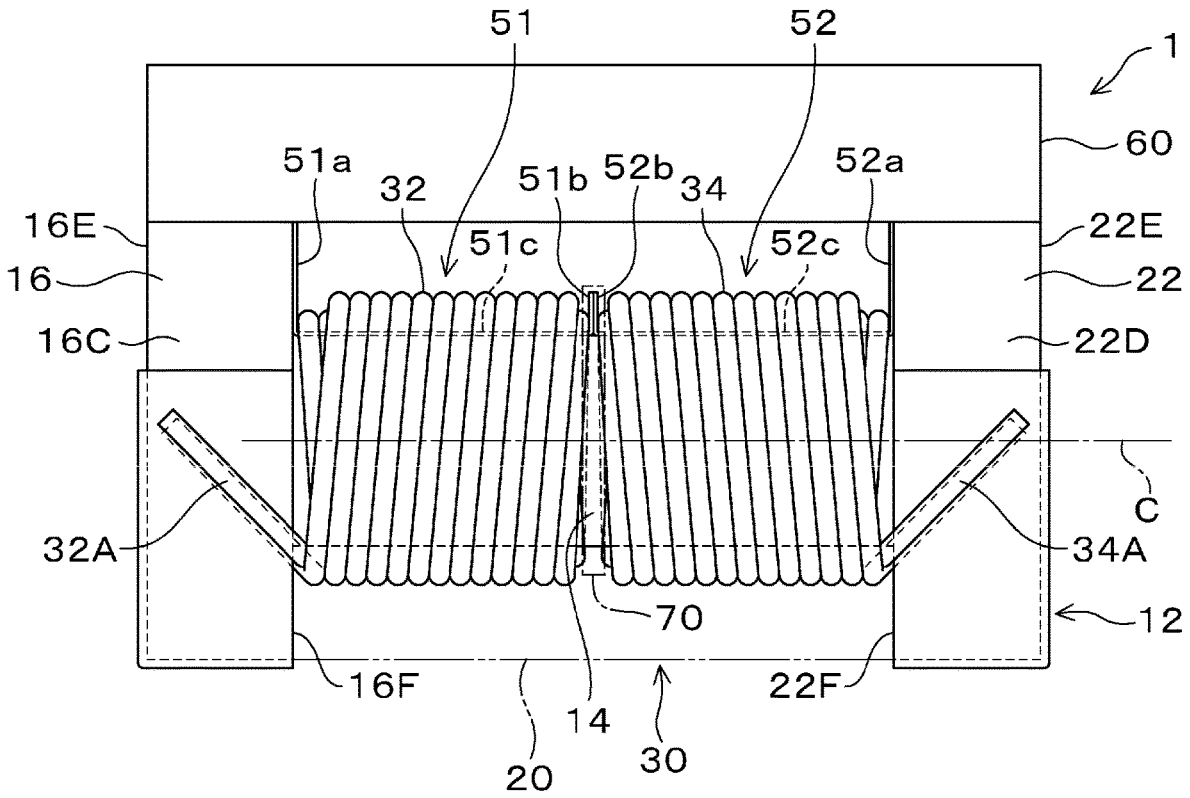
FIG. 2 is a front view of the coil component shown in FIG. 1.
Figure 3:
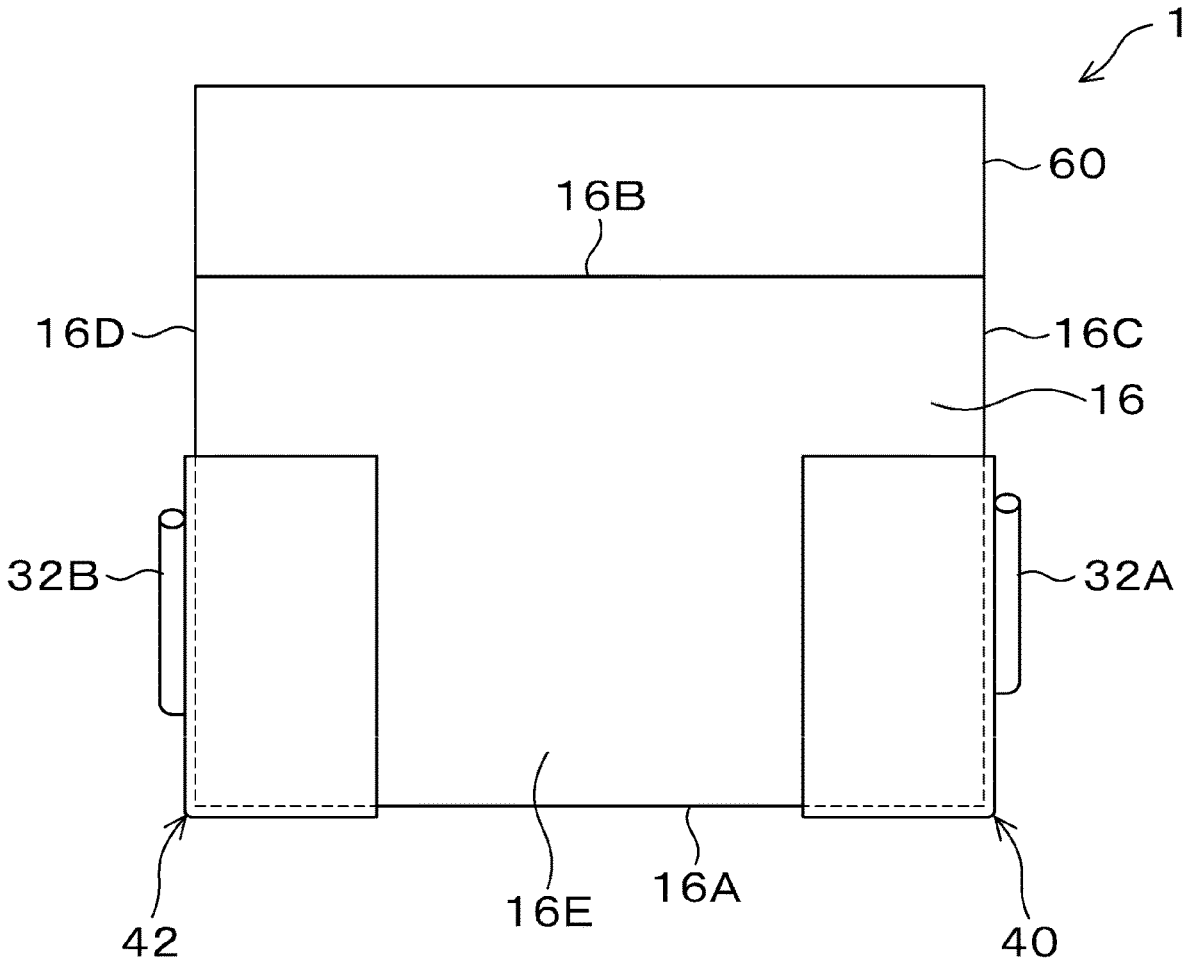
FIG. 3 is a left side view of the coil component shown in FIG. 1.
Figure 4:
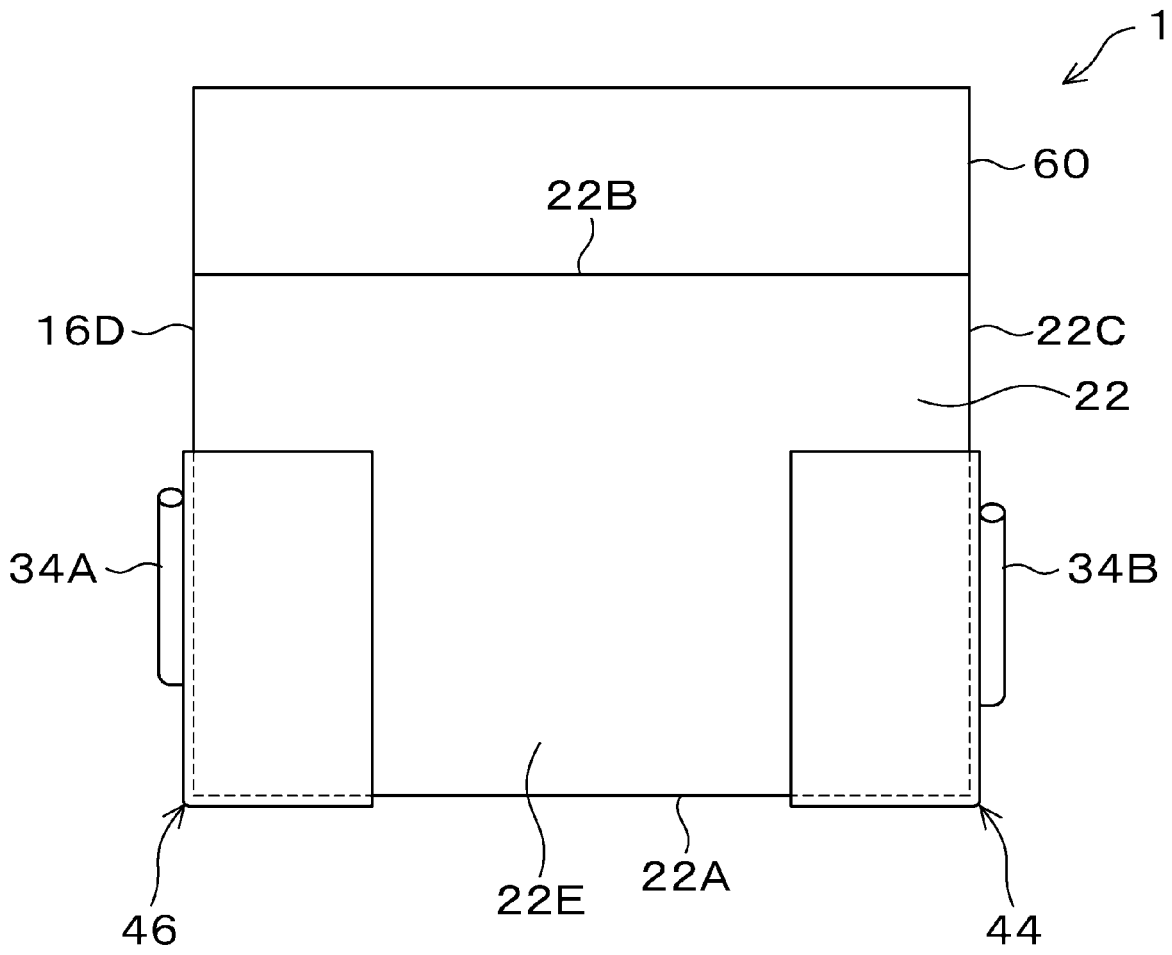
FIG. 4 is a right side view of the coil component shown in FIG. 1.

A coil component 1 according to one embodiment of the present invention will be hereinafter described with reference to FIGS. 1 to 4. FIG. 1 is a perspective view of the coil component 1 according to one embodiment of the present invention, FIG. 2 is a front view of the coil component 1 viewed from the front (viewed from the arrow F1*a*), FIG. 3 is a side view of the coil component 1 viewed from a left side thereof (viewed from the arrow F1*b*), and FIG. 4 is a side view of the coil component 1 viewed from a right side thereof (viewed from the arrow F1*c*).

The coil component 1 shown in the drawings is, for example, an inductor used to remove noise in an electronic circuit. The coil component 1 is either a power inductor built in a power supply line or an inductor used in a signal line.

In the illustrated embodiment, the coil component 1 includes: a drum core 12; winding wires 32, 34 wound around the drum core 12; an exterior portion 20 provided on the surface of the drum core 12 so as to cover the winding wires 32, 34; terminal electrodes 40, 42, 44, 46; insulating sheets 51, 52; and a plate core 60. The plate core 60 may be omitted from the coil component 1 if not necessary.

In one embodiment of the invention, the drum core 12 includes a winding core 14 that has a substantially rectangular cross section, a substantially rectangular parallelepiped flange 16 provided at one end of the winding core 14 with respect to the axial direction thereof (the direction parallel to the central axis C), and a substantially rectangular parallelepiped flange 22 provided at the other end of the winding core 14 with respect to the axial direction thereof. The drum core 12 is formed of, for example, a Ni—Zn ferrite material. In one embodiment of the invention, the permeability (μ) of the drum core 12 is in the range of 400 to 1,000, and is for example 500. The cross-sectional shape of the winding core 14 may be other than a rectangular, for example, it may be a polygon such as a hexagon or an octagon, or it may be a circle or an ellipse. The cross section of the winding core 14 may have any shape as long as it does not contradict the purport of the invention.

In one embodiment of the invention, the coil component 1 has a length 4.5 mm, a width 3.2 mm, and a height 2.8 mm. Here, the length of the coil component 1 is the dimension in an axial direction (the X direction in FIG. 1) of the winding core 14 of the drum core 12. The width of the drum core 12 is the dimension in a direction perpendicular to the X direction and parallel to a mounting surface (the Y direction in FIG. 1). The height of the drum core 12 is the dimension in a direction perpendicular to the X direction and the Y direction (the Z direction in FIG. 1). The winding core 14 of the drum core 12 has a width (the dimension in the Y direction in FIG. 1) of 1.6 mm and a height (the dimension in the Z direction in FIG. 1) of 0.8 mm. The drum core 12 has a length (the dimension in the X direction in FIG. 1) of 4.3 mm, a width (the dimension in the Y direction in FIG. 1) of 3.2 mm, and a height (the dimension in the Z direction in FIG. 1) of 2.1 mm.

The flange 16 has a lower surface 16A, an upper surface 16B, an end surface 16C, an end surface 16D, a side surface 16E, and a side surface 16F. The flange 22 has a lower surface 22A, an upper surface 22B, an end surface 22C, an end surface 22D, a side surface 22E and a side surface 22F. When the coil component 1 is mounted on a circuit board (not shown), the lower surface 16A and the lower surface 22A face the circuit board. Each of the end surfaces 16C and 16D intersects with the lower surface 16A at the lower end thereof, and each of the end surfaces 22C and 22D intersects with the lower surface 22A at the lower end thereof.

In one embodiment of the invention, the flanges 16, 22 have a thickness of 0.6 mm.

Figure 6:
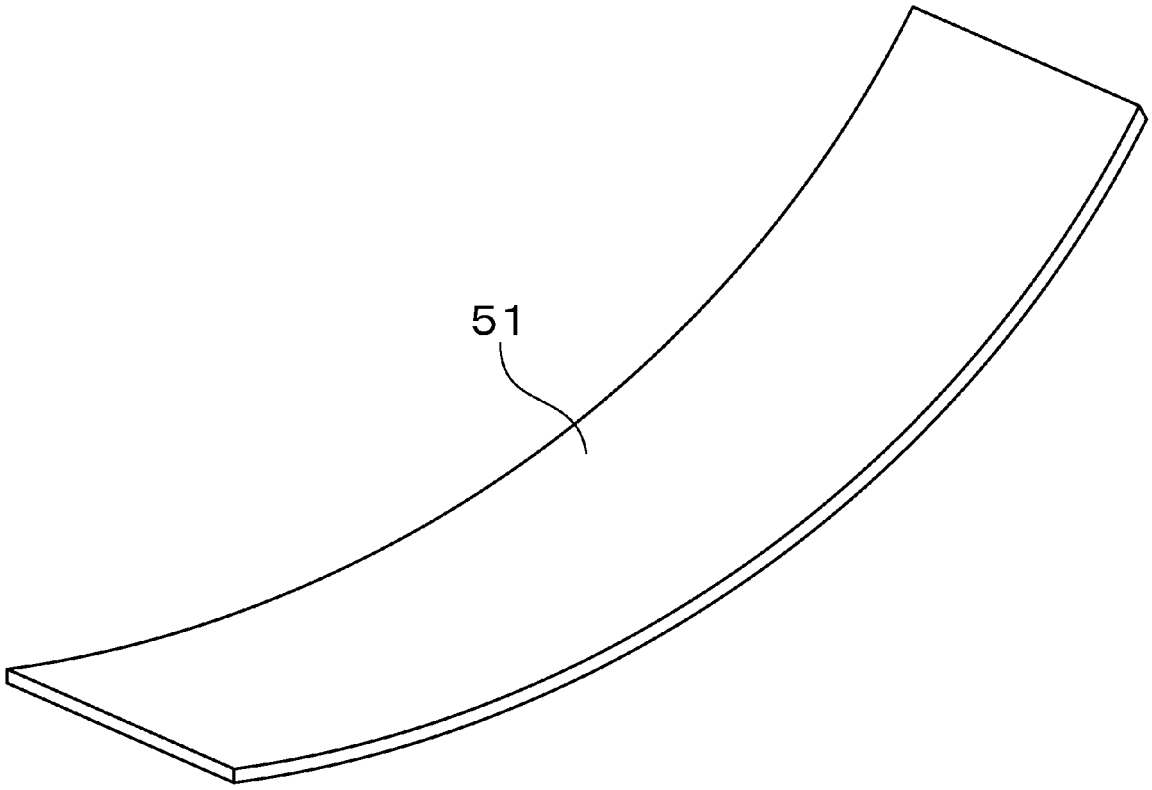
FIG. 6 is a schematic view showing an insulating tape.

In one embodiment of the present invention, as shown in FIG. 2, the insulating sheets 51, 52 are provided on the drum core so as to extend in a direction parallel to the central axis direction C of the winding core 14. In one embodiment of the present invention, both the insulating sheets 51, 52 are tape-shaped members made of a resin or a paper having an excellent insulating quality. In one embodiment, the insulating sheet 51 has a band shape, as shown in FIG. 6. Likewise, the insulating sheet 52 may also have a band shape. In one embodiment, the insulating sheets 51, 52 are flexible. The insulating sheets 51, 52 can be formed by, for example, cutting a length off a long sheet member rolled on a core. The insulating sheets 51, 52 may be constituted by a resin film formed of polyimide, polyethylene, or other resin materials.

In one embodiment of the present invention, both ends of the insulating sheet 51 are bent in a radially outward direction of the winding core 14. More specifically, a first end portion 51*a* of the insulating sheet 51 on the flange 16 side extends in a radially outward direction of the winding core 14 along the inner side surface 16F of the flange 16. A second end portion 51*b* of the insulating sheet 51 near the middle of the winding core 14 is bent in a radially outward direction of the winding core 14, in the vicinity of the middle of the winding core 14 with respect to the direction of the central axis C. The insulating sheet 51 includes an intermediate portion 51*c* between the first end portion 51*a* and the second end portion 51*b*. The intermediate portion 51*c* extends along the upper surface of the winding core 14.

In one embodiment of the present invention, the insulating sheet 52 is disposed symmetrically to the insulating sheet 51 with respect to the middle of the winding core 14 in the axial direction C. More specifically, a first end portion 52*a* of the insulating sheet 52 on the flange 22 side extends in a radially outward direction of the winding core 14 along the inner side surface 22F of the flange 22. A second end portion 52*b* of the insulating sheet 52 near the middle of the winding core 14 is bent in a radially outward direction of the winding core 14, in the vicinity of the middle of the winding core 14 with respect to the direction of the central axis C. The insulating sheet 52 includes an intermediate portion 52*c* between the first end portion 52*a* and the second end portion 52*b*. The intermediate portion 52*c* extends along the upper surface of the winding core 14.

In one embodiment, as shown in FIG. 2, the second end portion 51*b* of the insulating sheet 51 and the second end portion 52*b* of the insulating sheet 52 have approximately the same height as the height from the surface of the winding core 14 to the surface of the second tier of the winding wires 32, 34.

In one embodiment, both the insulating sheets 51, 52 have a width slightly smaller than the width of the upper surface of the winding core 14. In one embodiment, both the insulating sheets 51, 52 have a width of about 1 to 2 mm, a length of about 5 to 10 mm, and a thickness of about 1 to 200 μm.

The terminal electrodes 40, 42 are provided on the flange 16, and the terminal electrodes 44, 46 are provided on the flange 22. The terminal electrodes 40, 42, 44, 46 are constituted by metal parts formed by bending a metal plate made of phosphor bronze or copper. These metal parts are mounted to the flanges to serve as the terminal electrodes 40, 42, 44, 46. The terminal electrodes 40, 42, 44, 46 may be formed by baking Ag paste on the corresponding flanges 16, 22 and sequentially performing Ni plating and Sn plating on the surface of the baked Ag paste.

The exterior portion 20 is provided between the flange 16 and the flange 22 so as to cover at least a part of the winding wires 32, 34 wound around the winding core 14. The exterior portion 20 is formed of a thermosetting resin material having an excellent insulating quality. The exterior portion 20 includes a resin material such as an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, a polybenzoxazole (PBO) resin, or any other known resin materials used to cover winding wires in a wire-wound coil component. The exterior portion 20 may include filler particles in addition to the resin material. Examples of the filler particles include particles of a ferrite material, metal magnetic particles, particles of an inorganic material such as $SiO_2$ or $Al_2O_3$, and glass-based particles.

The plate core 60 is, for example, a plate-shaped member formed of a Ni—Zn ferrite material and is bonded to the upper surface 16B of the flange 16 and the upper surface 22B of the flange 22 with an epoxy (Tg specified at 125° C.). For example, the plate core 60 has a length of 4.5 mm, a width of 3.2 mm, and a height of 0.6 mm. In one embodiment of the disclosure, the permeability (μ) of the plate core 60 is in the range of 400 to 1,000, and is for example 500.

In the illustrated embodiment, both the winding wires 32, 34 are wound on the outer surface of the winding core 14 to form two tiers. It may also be possible that the winding wires 32, 34 are wound around the winding core 14 to form more than two tiers.

The winding wire 32 is electrically connected to the terminal electrode 40 at one end 32A thereof and is also electrically connected to the terminal electrode 42 at the other end 32B thereof. The one end 32A and the other end 32B of the winding wire 32 are fixed to the terminal electrodes 40, 42, respectively, by thermal compression bonding, for example. The winding wire 32 is wound, in the direction of the central axis C of the winding core 14, on a region between the first end portion 51*a* of the insulating sheet 51 disposed along the inner side surface 16F of the flange 16 and the second end portion 51*b* of the insulating sheet 51 disposed in the vicinity of the middle of the winding core 14.

The winding wire 34 is electrically connected to the terminal electrode 46 at one end 34A thereof and is also electrically connected to the terminal electrode 44 at the other end 34B thereof. The one end 34A and the other end 34B of the winding wire 34 are fixed to the terminal electrodes 46, 44, respectively, by thermal compression bonding, for example. The winding wire 34 is wound, in the direction of the central axis C of the winding core 14, on a region between the first end portion 52*a* of the insulating sheet 52 disposed along the inner side surface 22F of the flange 22 and the second end portion 52*b* of the insulating sheet 52 disposed in the vicinity of the middle of the winding core 14.

Since the intermediate portion 51*c* of the insulating sheet 51 and the intermediate portion 52*c* of the insulating sheet 52 are disposed on the upper surface of the winding core 14, the winding wires 32, 34 are wound around the winding core 14 with the insulating sheets 51, 52 interposed therebetween.

The second end portion 51*b* of the insulating sheet 51 and the second end portion 52*b* of the insulating sheet 52 are interposed between the winding wire 32 and the winding wire 34, so as to physically space the winding wire 32 and the winding wire 34 from each other in the direction of the central axis C. Thus, the second end portion 51*b* of the insulating sheet 51 and the second end portion 52*b* of the insulating sheet 52 are configured and disposed to form a gap between the winding wire 32 and the winding wire 34. Therefore, the second end portion 51*b* of the insulating sheet 51 and the second end portion 52*b* of the insulating sheet 52 may be herein referred collectively to as a spacer 70.

In addition to the second end portion 51*b* of the insulating sheet 51 and the second end portion 52*b* of the insulating sheet 52, a part of the exterior portion 20 may also be disposed between the winding wire 32 and the winding wire 34. For example, the second end portion 51*b* of the insulating sheet 51 and the second end portion 52*b* of the insulating sheet 52 are not disposed on the lower surface of the winding core 14 and both side surfaces between the upper surface and the lower surface of the winding core 14, and therefore, a part of the exterior portion 20 constituted by a resin material may be disposed on the lower surface and both side surfaces of the winding core 14 in the gap between the winding wire 32 and the winding wire 34. When a part of the exterior portion 20 is disposed in the gap between the winding wire 32 and the winding wire 34, the spacer 70 may refer collectively to the second end portion 51*b* of the insulating sheet 51, the second end portion 52*b* of the insulating sheet 52, and the part of the exterior portion 20 that is disposed between the winding wire 32 and the winding wire 34.

Since the spacer 70 is entirely formed of the members having an excellent insulating quality, the winding wire 32 and the winding wire 34 are electrically insulated from each other by the spacer 70.

Next, one example of a production method of the coil component 1 will be described with reference to FIG. 5. First, as shown in Part (a) of FIG. 5, the drum core 12 and a sheet member 50 to be formed into the insulating sheets 51, 52 are prepared. The drum core 12 is set on a known coil winding machine. The coil winding machine used for producing the coil component 1 may be a spindle-type coil winding machine, a flyer-type coil winding machine, or other known coil winding machines. When a spindle-type coil winding machine is used, the drum core 12 is pivotally supported by a spindle of the spindle-type coil winding machine. The sheet member 50 is supported by the spindle-type coil winding machine at both ends 50*a*, 50*b* and a middle portion thereof.

Figure 5:
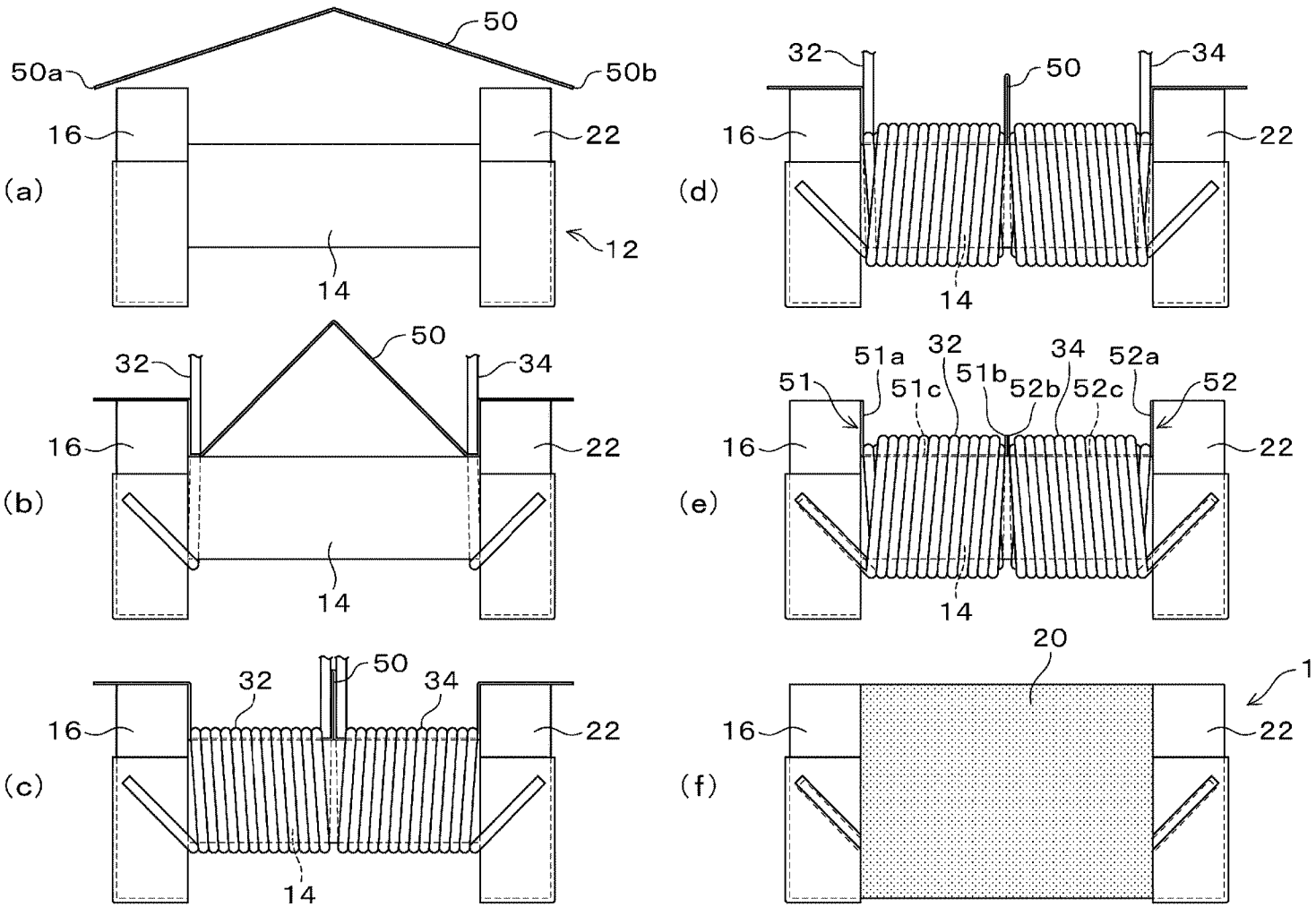
FIG. 5 is a schematic view showing a production process of the coil component shown in FIG. 1.

Next, as shown in Part (b) of FIG. 5, winding of the winding wires 32, 34 is started. More specifically, the one end 32A of the winding wire 32 fed from a first nozzle is connected to the terminal electrode 40, and the one end 34A of the winding wire 34 fed from a second nozzle is connected to the terminal electrode 46.

Next, the positions of the first nozzle and the second nozzle are adjusted such that the first nozzle is close to the side surface 16F of the flange 16 and the second nozzle is close to the side surface 22F of the flange 22. Further, the positions of the first nozzle and the second nozzle are adjusted so as to tension the winding wires 32, 34 and thereby contact the winding wires 32, 34 with an outer peripheral surface of the winding core 14.

Next, the first nozzle is moved from the vicinity of the flange 16 toward the middle of the winding core 14 with respect to the direction of the central axis C, and the second nozzle is moved from the vicinity of the flange 22 toward the middle of the winding core 14 with respect to the direction of the central axis C (in the opposite direction than the first nozzle), while the drum core 12 is rotated around the central axis C. Thus, as shown in Part (c) of FIG. 5, the winding wire 32 is wound on the winding core 14 to form a first tier thereof from the side surface 16F of the flange 16 to the vicinity of the middle of the winding core 14, and the winding wire 34 is wound on the winding core 14 to form a first tier thereof from the side surface 22F of the flange 22 to the vicinity of the middle of the winding core 14.

In Part (c) of FIG. 5, the winding wires 32, 34 are opposed to each other in the direction of the central axis C of the winding core 14 with the sheet member 50 interposed therebetween. The sheet member 50 is folded at the vicinity of the middle thereof, and the folded portion is interposed between the winding wires 32, 34. Therefore, the distance between the winding wires 32, 34 is approximately equal to double the thickness of the sheet member 50.

When the winding wires 32, 34 have been wound to the position as shown in Part (c) of FIG. 5, the first nozzle and the second nozzle start to move in the opposite directions with respect to the direction of the central axis C. That is, the first nozzle starts to move from the vicinity of the middle of the winding core 14 with respect to the direction of the central axis C toward the flange 16, and the second nozzle starts to move from the vicinity of the middle of the winding core 14 with respect to the direction of the central axis C toward the flange 22. While the first nozzle and the second nozzle are moved in this manner, the drum core 12 is rotated around the central axis C, thereby to wind the winding wires 32, 34 to form respective second tiers. When the first nozzle is moved to the vicinity of the flange 16 and the second nozzle is moved to the vicinity of the flange 22, as shown in Part (d) of FIG. 5, the winding wire 32 is wound to form a second tier thereof from the vicinity of the middle of the winding core 14 to the vicinity of the side surface 16F of the flange 16, and the winding wire 34 is wound to form a second tier thereof from the vicinity of the middle of the winding core 14 to the vicinity of the side surface 22F of the flange 22.

Next, the drum core 12 is stopped rotating, and the winding wires 32, 34 are disconnected from the first nozzle and the second nozzle, respectively. Next, the end 32B of the winding wire 32 is connected to the terminal electrode 42, and the end 34B of the winding wire 34 is connected to the terminal electrode 44.

Next, the unnecessary part of the sheet member 50 is cut away. More specifically, the middle portion of the sheet member 50 that is exposed beyond the surfaces of the winding wires 32, 34 is cut away. In addition, both end portions of the sheet member 50 that extend outward beyond the flange 16 and the flange 22, respectively, are cut away. Thus, as shown in Part (e) of FIG. 5, the insulating sheet 51 and the insulating sheet 52 are obtained. That is, the sheet member 50 cut at the middle portion thereof is divided into a portion on the flange 16 side serving as the insulating sheet 51 and a portion on the flange 22 side serving as the insulating sheet 52.

Next, a resin material is injected and cured between the flange 16 and the flange 22 so as to cover the winding wires 32, 34, thereby to form the exterior portion 20. Thus, the coil component 1 is obtained.

Figure 7:
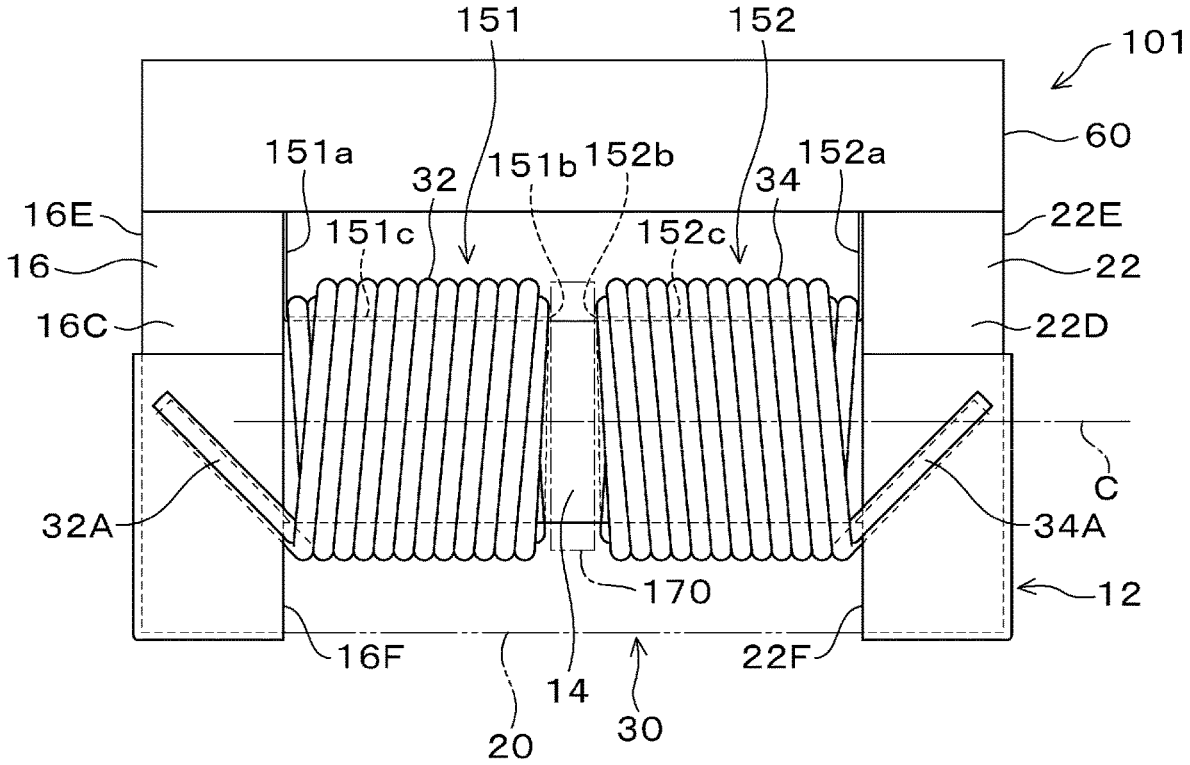
FIG. 7 is a front view showing a coil component according to another embodiment of the present invention.
Figure 8:
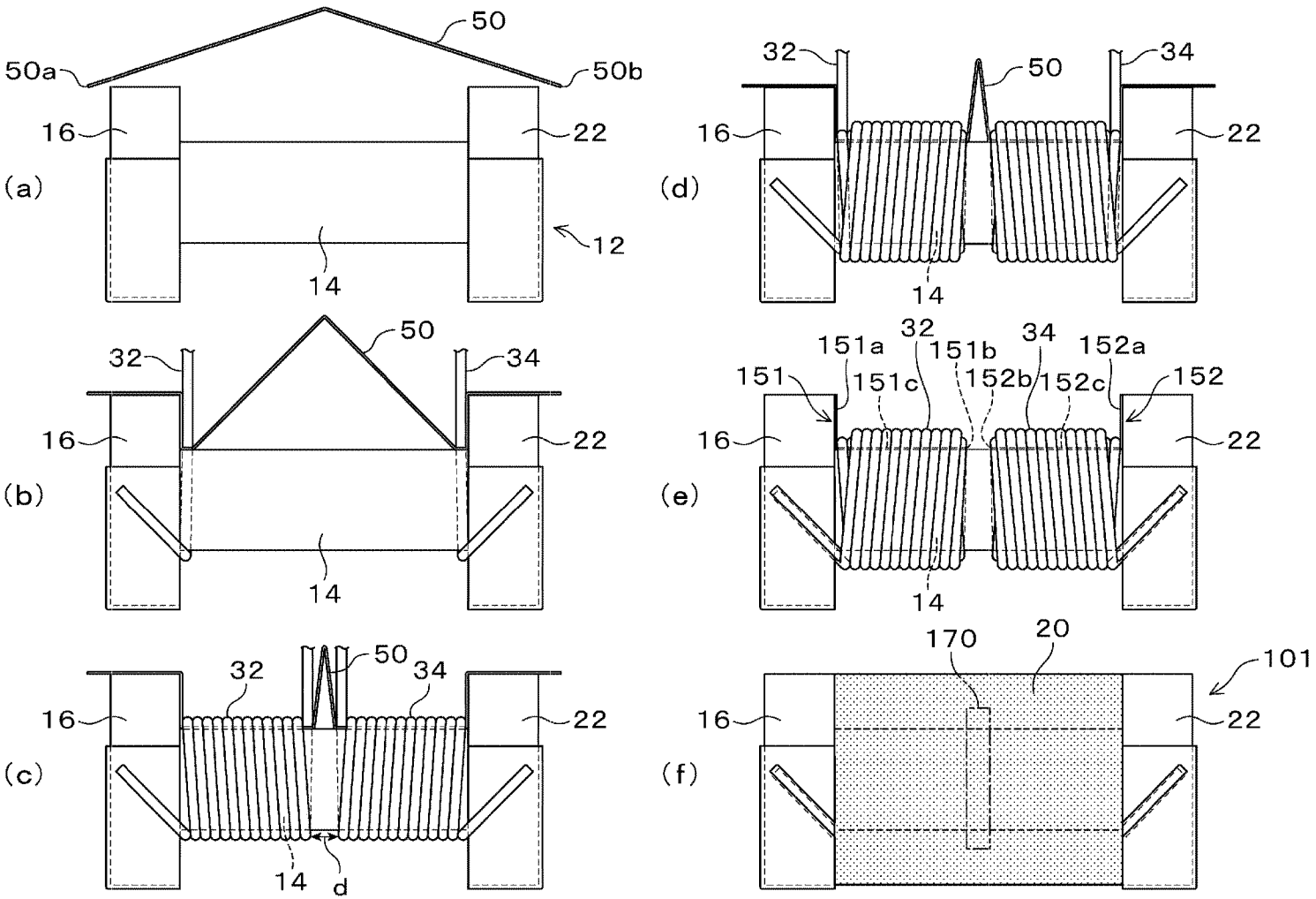
FIG. 8 is a schematic view showing a production process of the coil component according to the other embodiment of the present invention.

Next, a coil component 101 according to another embodiment of the present invention will be described with reference to FIGS. 7 and 8. FIG. 7 is a front view showing the coil component 101 according to the other embodiment of the present invention, and FIG. 8 is a schematic view showing a production process of the coil component 101.

In the coil component 101, insulating sheets 151, 152 are substituted for the insulating sheets 51, 52 of the coil component 1 shown in FIG. 1. Further, in the coil component 101, a spacer 170 is substituted for the spacer 70 of the coil component 1 shown in FIG. 1. The following description will be focused on the features of the coil component 101 different from those of the coil component 1.

The insulating sheet 151 is different from the insulating sheet 51 in that an end portion thereof near the middle of the winding core 14 with respect to the direction of the central axis C does not extend in the radially outward direction of the winding core 14. A first end portion 151*a* of the insulating sheet 151 on the flange 16 side extends in a radially outward direction of the winding core 14 along the inner side surface 16F of the flange 16. The second end portion 151*b* of the insulating sheet 151 near the middle of the winding core 14, and the intermediate portion 151*c* of the insulating sheet 151 disposed between the first end portion 151*a* and the second end portion 151*b*, extend along the upper surface of the winding core 14.

The insulating sheet 152 is different from the insulating sheet 52 in that an end portion thereof near the middle of the winding core 14 with respect to the direction of the central axis C does not extend in the radially outward direction of the winding core 14. A first end portion 152*a* of the insulating sheet 152 on the flange 22 side extends in a radially outward direction of the winding core 14 along the inner side surface 22F of the flange 22. The second end portion 152*b* of the insulating sheet 152 near the middle of the winding core 14, and the intermediate portion 152*c* of the insulating sheet 152 disposed between the first end portion 152*a* and the second end portion 152*b*, extend along the upper surface of the winding core 14.

The spacer 170 is disposed between the winding wire 32 and the winding wire 34. In the coil component 101, a part of the exterior portion 20 is disposed between the winding wire 32 and the winding wire 34. In the coil component 101, the part of the exterior portion 20 disposed between the winding wire 32 and the winding wire 34 constitutes the spacer 170.

As does the spacer 70, the spacer 170 physically separates the winding wire 32 and the winding wire 34 from each other in the direction of the central axis C and electrically insulates the winding wire 32 and the winding wire 34 from each other. The spacer 170 is different from the spacer 70 of the coil component 1 in that it does not include an insulating sheet.

Next, a production method of the coil component 101 will be described with reference to FIG. 8. Steps of the production method of the coil component 101 that are the same as for the coil component 1 will not be described in detail.

First, as shown in Part (a) of FIG. 8, the drum core 12 and a sheet member 50 to be formed into the insulating sheets 151, 152 are prepared. The sheet member 50 is supported by a coil winding machine at both ends 50*a*, 50*b* and a middle portion thereof.

Next, as shown in Part (b) of FIG. 8, winding of the winding wires 32, 34 is started. More specifically, the one end 32A of the winding wire 32 fed from a first nozzle is connected to the terminal electrode 40, and the one end 34A of the winding wire 34 fed from a second nozzle is connected to the terminal electrode 46. Next, the first nozzle is moved from the vicinity of the flange 16 toward the middle of the winding core 14 with respect to the direction of the central axis C, and the second nozzle is moved from the vicinity of the flange 22 toward the middle of the winding core 14 with respect to the direction of the central axis C, while the drum core 12 is rotated around the central axis C. Thus, as shown in Part (c) of FIG. 8, the winding wires 32, 34 are wound around the winding core 14 to from respective first tiers. The first tiers of the winding wires 32, 34 are wound around the winding core 14 so as to maintain a distance d between the winding wire 32 and the winding wire 34 in the direction of the central axis C. The distance d is larger than double the thickness of the sheet member 50. That is, winding of the winding wires 32, 34 to form the first tiers is ended before the sheet member 50 is tightly sandwiched between the winding wire 32 and the winding wire 34.

When winding of the winding wires 32, 34 to form the first tiers is completed, the first nozzle and the second nozzle start to move in the opposite directions with respect to the direction of the central axis C. While the first nozzle and the second nozzle are moved in this manner, the drum core 12 is rotated around the central axis C, thereby to wind the winding wires 32, 34 to form respective second tiers. When the first nozzle is moved to the vicinity of the flange 16 and the second nozzle is moved to the vicinity of the flange 22, as shown in Part (d) of FIG. 8, the winding wire 32 is wound to form a second tier thereof from the vicinity of the middle of the winding core 14 to the vicinity of the side surface 16F of the flange 16, and the winding wire 34 is wound to form a second tier thereof from the vicinity of the middle of the winding core 14 to the vicinity of the side surface 22F of the flange 22.

Next, the drum core 12 is stopped rotating, and the winding wires 32, 34 are disconnected from the first nozzle and the second nozzle, respectively. Next, the end 32B of the winding wire 32 is connected to the terminal electrode 42, and the end 34B of the winding wire 34 is connected to the terminal electrode 44.

Next, the unnecessary part of the sheet member 50 is cut away. More specifically, the middle portion of the sheet member 50 that is exposed beyond the surfaces of the winding wires 32, 34 is cut away. In addition, both end portions of the sheet member 50 that extend outward beyond the flange 16 and the flange 22, respectively, are cut away. Thus, as shown in Part (e) of FIG. 8, the insulating sheet 151 and the insulating sheet 152 are obtained. That is, the sheet member 50 cut at the middle portion thereof is divided into a portion on the flange 16 side serving as the insulating sheet 151 and a portion on the flange 22 side serving as the insulating sheet 152.

Next, a resin material is injected and cured between the flange 16 and the flange 22 so as to cover the winding wires 32, 34, thereby to form the exterior portion 20. Thus, the coil component 101 is obtained.

In the coil components 1, 101, the material of the spacers 70, 170 can be changed to modify the permeability of the spacers 70, 170. As a result, the coupling coefficient between the coil of winding wire 32 and the coil of winding wire 34 can be adjusted.

In the coil components 1, 101, the widths of the spacers 70, 170 in the direction of the central axis C can be changed to adjust the coupling coefficient between the coil of winding wire 32 and the coil of winding wire 34.

Since the spacers 70, 170 are made separate from (the winding core 14 of) the drum core 12, the spacers 70, 170 can be readily changed in the material and the widths in the direction of the central axis C. Therefore, in the coil components 1, 101 of the above embodiments, the coupling coefficient can be readily adjusted.

Through the production processes shown in FIGS. 5 and 8, the spacers 70, 170 can be positioned accurately near the middle of the winding core 14 with respect to the direction of the central axis C.

Figure 9:
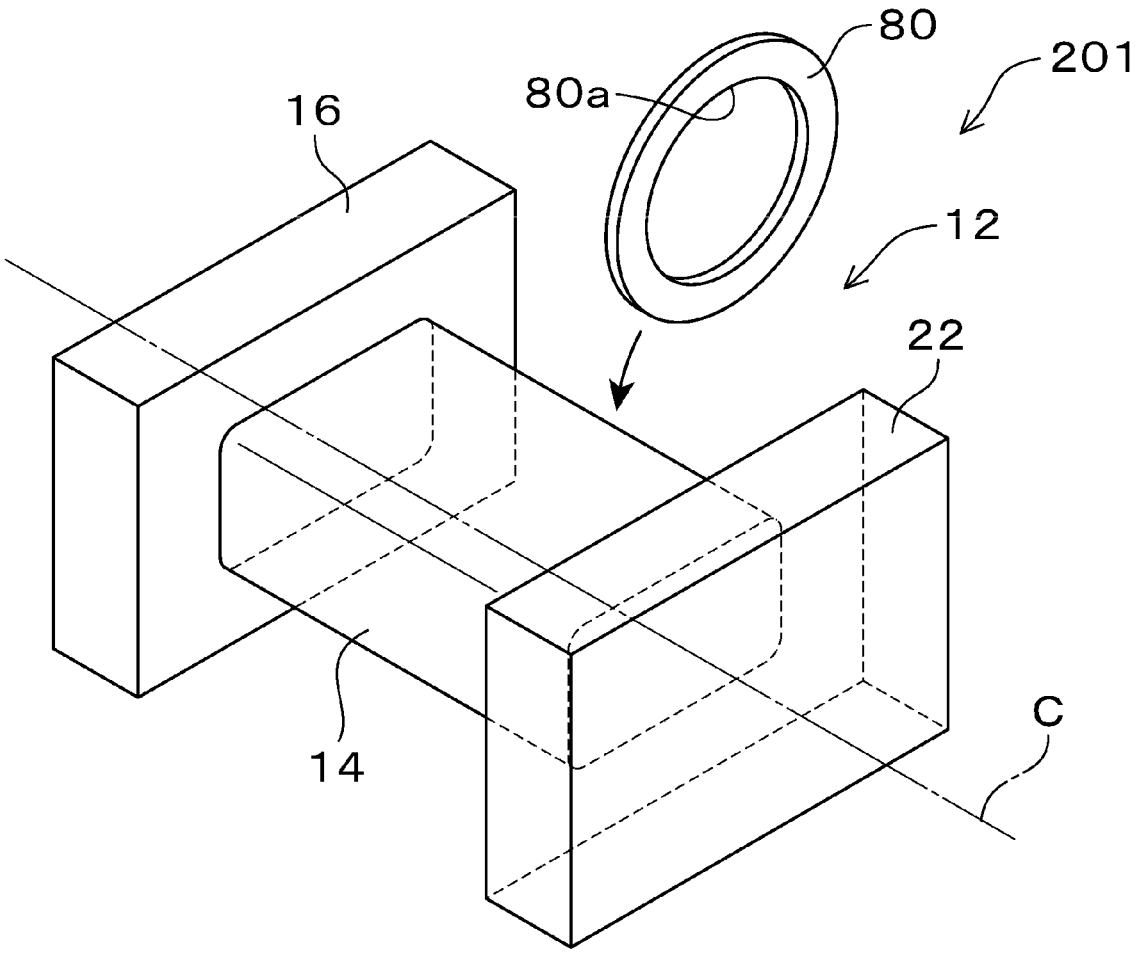
FIG. 9 is a perspective view showing a coil component according to still another embodiment of the present invention.
Figure 10:
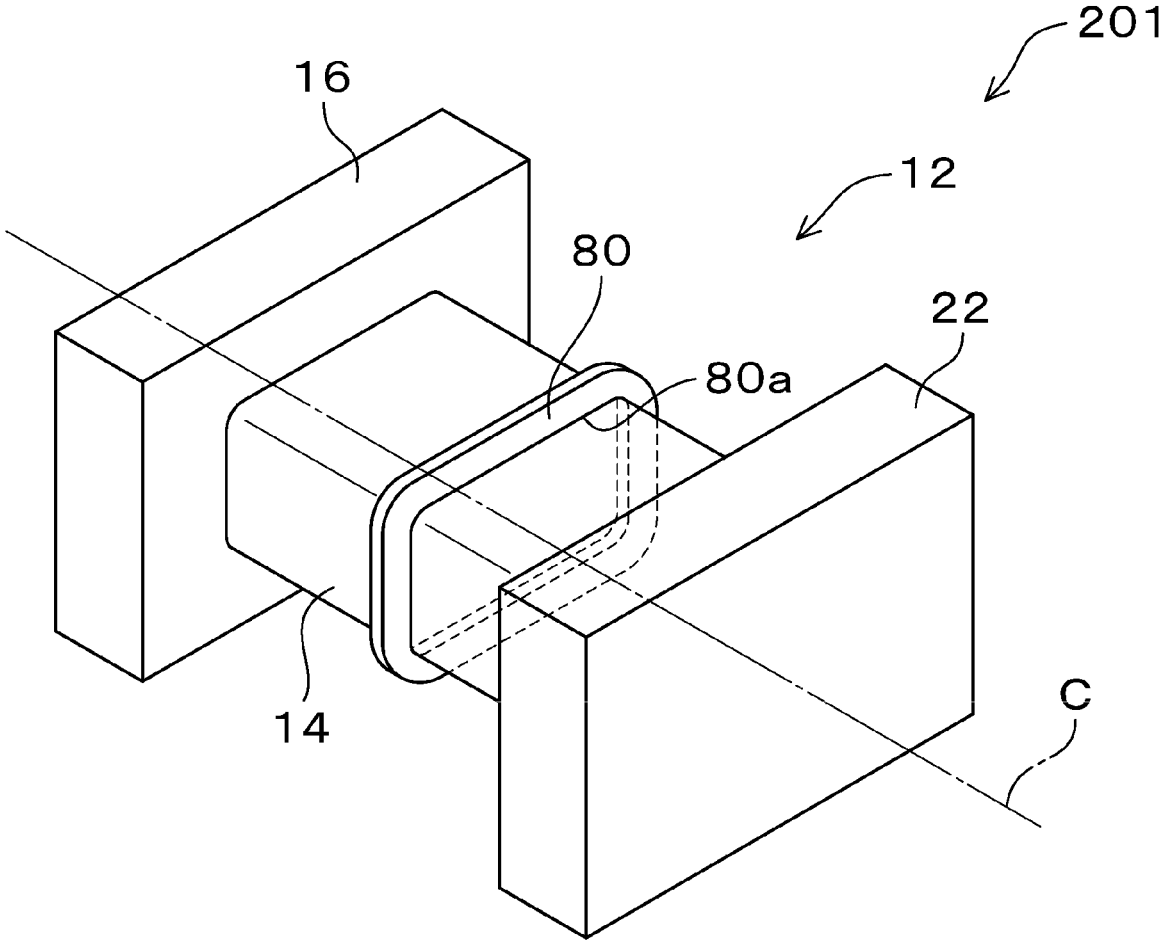
FIG. 10 is a perspective view showing the coil component according to the still another embodiment of the present invention.

Next, still another embodiment of the present invention will be described with reference to FIGS. 9 and 10. FIGS. 9 and 10 are perspective views showing a coil component 201 according to the still another embodiment of the present invention. In FIGS. 9 and 10, the winding wires and the exterior portion are omitted for convenience of description.

In the coil component 201, a ring 80 is substituted for the insulating sheets 51, 52 of the coil component 1 shown in FIG. 1. The ring 80 is fitted around the winding core 14. The following description will be focused on the features of the coil component 201 different from those of the coil component 1.

The ring 80 is a plate-shaped member having a through-hole 80*a* formed in the middle thereof. The outer shape of the ring 80 as viewed from the front is a rectangular, a polygon, a circle, an ellipse, or other geometric configuration. The shape of the through-hole 80*a* of the ring 80 as viewed from the front is a rectangular, a polygon, a circle, an ellipse, or other geometric configuration. In the example shown in FIG. 9, the ring 80 has an approximately circular outer shape as viewed from the front, and the through-hole 80*a* also has an approximately circular shape as viewed from the front. The outer shape of the ring 80 and the shape of the through-hole 80*a* are either identical (e.g., both are circular) or different (e.g., the outer shape is rectangular and the through-hole 80*a* is circular).

In one embodiment of the present invention, the though-hole 80*a* has the same shape and size as the cross section of the winding core 14. In one embodiment of the present invention, the though-hole 80*a* has the same shape as and a different size than the cross section of the winding core 14. In one embodiment of the present invention, the through-hole 80*a* is configured such that, when the ring 80 is mounted on the drum core 12, the ring 80 is partially or entirely in contact with the periphery of the outer peripheral surface of the winding core 14 at a position on the winding core 14 with respect to the direction of the central axis C.

In one embodiment of the present invention, the ring 80 may be disposed between a pair of winding wires (e.g., the winding wires 32 and 34 shown in the drawings such as FIG. 2) so as not to contact with the winding core 14. For example, the ring 80 may be bonded to the coil surfaces of the pair of winding wires opposed to each other, and thus disposed between the pair of winding wires so as not to contact with the winding core 14.

The ring 80 may have a part cut in the peripheral direction. For example, the ring 80 has a C shape as viewed from the front. The ring 80 having a part cut in the peripheral direction is mounted on the winding core 14 such that the wall surface thereof defining the through-hole 80*a* is in contact with a part of the periphery of the winding core 14. It may also be possible that the ring 80 having a part cut in the peripheral direction is disposed between a pair of winding wires so as not to contact with the winding core 14.

The ring 80 may be constituted by two or more members. For example, the ring 80 may be formed by joining a pair of members each shaped semicircular as viewed from the front.

In one embodiment, the ring 80 has a thickness of about 1 to 200 μm. When the ring 80 is mounted on the winding core 14, the thickness of the ring 80 refers to the dimension thereof parallel to the central axis C of the winding core.

In one embodiment, the ring 80 is formed of, for example, polyimide, polyester, or other resin materials having an excellent insulating quality. For example, the ring 80 is formed of a flexible resin material.

The shapes and materials of the ring 80 described above are mere examples. The ring 80 can have any shape that conforms to the purport of the present invention. The ring 80 may be formed of various materials other than resin materials, for example, glass or non-magnetic ceramics such as zirconia or alumina.

The ring 80 may be formed of a magnetic material. The magnetic material used for the ring 80 is, for example, ferrite, soft magnetic alloy materials, or any other magnetic materials. Use of the ring 80 formed of a magnetic material makes the coupling coefficient between a pair of coils larger than use of the ring 80 formed of a non-magnetic material.

In one embodiment of the present invention, the ring 80 is formed of a material different from that of the winding core 14. The ring 80 may be formed of a material having a lower permeability than the material of the winding core 14. This prevents leakage of magnetic flux from the winding core 14 to a region between the pair of winding wires.

The first step to produce the coil component 201 is to prepare the drum core 12 and the ring 80. When the ring 80 is flexible, the ring 80 is stretched to enlarge the through-hole 80*a*, and the drum core 12 is inserted into the enlarged through-hole 80*a* from the flange 16 side or the flange 22 side. The ring 80 is moved on the surface of the winding core 14 to a predetermined position on the winding core 14 with respect to the direction of the central axis C. The ring 80 is positioned, for example, at the middle of the winding core 14 with respect to the central axis C.

In one embodiment, the ring 80 may be fixed to the winding core 14 by bonding, for example. In another embodiment of the present invention, the ring 80 may be fixed to the winding core 14 without use of a bonding agent. For example, the ring 80 may be configured such that the wall surface thereof defining the through-hole 80*a* is press-fitting on the outer peripheral surface of the winding core 14. Since the ring 80 is fixed on the winding core 14 without use of a bonding agent, it is possible to prevent a change of stray capacitance of the winding wires due to the bonding agent.

In another embodiment, the ring 80 may be provided on the surface of the winding core 14 so as to be movable in the direction of the central axis C. Since the ring 80 is movably provided on the winding core 14, it is possible to readily adjust the winding capacitance between the flange 16 and the ring 80 and the winding capacitance between the flange 22 and the ring 80.

In one embodiment of the present invention, the ring 80 is positioned eccentrically to the winding core 14. For example, the ring 80 is positioned such that the center of the ring 80 as viewed from the front thereof is not aligned with the center of the cross section of the winding core 14 (or an intersection point of two diagonal lines when the cross section is a rectangle as shown) in the direction of the central axis C. For example, when the through-hole 80*a* of the ring 80 is slightly larger than the outer shape of the cross section of the winding core 14, it is possible to position the ring 80 eccentrically to the winding core 14. Thus, the coupling coefficient can be adjusted finely by using the ring 80.

The coil component 201 may include two or more rings 80. When two or more rings 80 are provided, the two or more rings 80 are fitted on the surface of the winding core 14 so as to be spaced apart from each other in the direction of the central axis C.

After the ring 80 is disposed on the winding core 14, two winding wires are wound around the winding core 14. These winding wires are wound in generally the same manner as the winding wires 32, 34 described with reference to FIG. 5. In the embodiment, no insulating sheet is necessary in winding the winding wires.

More specifically, the winding wires in the embodiment are wound in the following manner. First, two winding wires fed from nozzles of a coil winding machine are connected to corresponding terminal electrodes at respective ends. One of the terminal electrodes is provided on the flange 16, and the other is provided on the flange 22. Next, the nozzles of the coil winding machine are moved toward the middle of the winding core 14 with respect to the direction of the central axis C, while the drum core 12 is rotated around the central axis C. Thus, one of the winding wires is wound to form a first tier thereof from the flange 16 to the vicinity of the middle of the winding core 14, and the other of the winding wires is wound to form a first tier thereof from the flange 22 to the vicinity of the middle of the winding core 14. The respective first tiers of the pair of winding wires are opposed to each other in the direction of the central axis C of the winding core 14 with the ring 80 interposed therebetween. Since the ring 80 is interposed between the pair of winding wires, the distance between the pair of winding wires is equal to the thickness of the ring 80. Next, while the nozzles are moved in the opposite direction with respect to the central axis C, the drum core 12 is rotated around the central axis C, thereby to wind the pair of winding wires to form respective second tiers. When the second tiers are complete, the drum core 12 is stopped rotating, the pair of winding wires are disconnected from the nozzles, and the disconnected ends of the pair of winding wires are connected to the terminal electrodes. Next, a resin material is injected and cured between the flange 16 and the flange 22 so as to cover the winding wires, thereby to form the exterior portion 20. Thus, the coil component 201 is obtained.

The rings 80 may be herein collectively referred to as a spacer 180.

When the insulating sheets 51, 52, 151, 152 constituting the spacers 70, 170 are made of flexible resin sheets, it is possible to reduce mechanical breakdown of the spacers 70, 170. Further, when the ring 80 is made of a flexible resin material, it is possible to reduce mechanical breakdown of the spacer 180. Therefore, in the above embodiments, the coupling coefficient can be adjusted using members less prone to be broken.

In the above embodiments, the thicknesses and/or materials of the insulating sheets 51, 52, 151, 152 or the ring 80 can be changed to adjust the coupling coefficient of the coil components 1, 101, 201. Therefore, in the above embodiments, the coupling coefficient between the coil of the winding wire 32 and the coil of the winding wire 34 can be adjusted.

In the above embodiments, all of the spacers 70, 170 and the ring 80 are separate from (the winding core 14 of) the drum core 12, and therefore, it is possible to adjust the coupling coefficient of a coil component including a general-purpose drum core (not having an intermediate flange) for use in coil components.

The dimensions, materials, and arrangements of the various constituents described in this specification are not limited to those explicitly described for the embodiments, and the various constituents can be modified to have any dimensions, materials, and arrangements within the scope of the present invention. The constituents other than those explicitly described herein can be added to the described embodiments; and part of the constituents described for the embodiments can be omitted.

What is claimed is:

1. A coil component, comprising: a drum core including a winding core, a first flange, and a second flange, the first flange being provided on one axial end of the winding core, the second flange being provided on another axial end of the winding core; a spacer provided on a surface of the winding core between the first flange and the second flange, the spacer being separate from the winding core; a first winding wire wound around the winding core between the first flange and the spacer; and a second winding wire wound around the winding core between the second flange and the spacer; wherein at least a part of the spacer is made of an insulating sheet; wherein one end of the insulating sheet is fixed to the first flange, and another end of the insulating sheet is fixed to the second flange, the first winding wire is wound around the winding core with the insulating sheet interposed therebetween, and the second winding wire is wound around the winding core with the insulating sheet interposed therebetween.

2. The coil component of claim 1, wherein the spacer is made of a flexible member.

3. The coil component of claim 1, wherein the insulating sheet has a band.

4. The coil component of claim 1, wherein the insulating sheet is provided on the drum core so as to extend along an axial direction of the winding core.

5. The coil component of claim 1, further comprising an insulating exterior portion provided around the winding core so as to cover at least a part of the first and second winding wires, wherein the spacer includes a part of the insulating exterior portion.

6. The coil component of claim 5, wherein the spacer further includes a part of the insulating sheet.

7. The coil component of claim 5, wherein a gap is formed between the first winding wire and the second winding wire, and wherein the insulating exterior portion is further disposed in the gap between the first and second winding wires.

8. The coil component of claim 1, wherein the spacer is made of a first insulating sheet and a second insulating sheet, the second insulating sheet being disposed symmetrically to the first insulating sheet, wherein each of the first insulating sheet and the second insulating sheet have a first end portion and a second end portion, wherein the second end portions of the first insulating sheet and the second insulating sheet extend in a radially outward direction with respect to the winding core, and wherein the second end portions of the first insulating sheet and the second insulating sheet are interposed between the first winding wire and the second winding wire.

9. The coil component of claim 8, wherein the first end portions of the first insulating sheet and the second insulating sheet also extend in the radially outward direction with respect to the winding core along an inner side surface of the first flange and the second flange.

10. The coil component of claim 1, wherein the spacer is a ring fitted around the winding core.

11. The coil component of claim 10, wherein the ring is made of an insulating material.

12. The coil component of claim 10, wherein the ring is made of a magnetic material.

13. The coil component of claim 10, wherein the ring is positioned eccentrically to the winding core.

* * * * *